US011952166B2

(12) United States Patent
Mendleson et al.

(10) Patent No.: US 11,952,166 B2
(45) Date of Patent: Apr. 9, 2024

(54) CONTAINER AND INTEGRATED CONNECTOR SYSTEM

(71) Applicants: Matthew J. Mendleson, Schenectady, NY (US); Manisha Tinani-Mendleson, Schenectady, NY (US)

(72) Inventors: Matthew J. Mendleson, Schenectady, NY (US); Manisha Tinani-Mendleson, Schenectady, NY (US)

( * ) Notice: Subject to any disclaimer, the term of this patent is extended or adjusted under 35 U.S.C. 154(b) by 0 days.

(21) Appl. No.: 17/807,743

(22) Filed: Jun. 20, 2022

(65) Prior Publication Data

US 2023/0064548 A1 Mar. 2, 2023

Related U.S. Application Data

(60) Provisional application No. 63/237,749, filed on Aug. 27, 2021.

(51) Int. Cl.

| | |
|---|---|
| ***B65D 21/02*** | (2006.01) |
| ***B65D 1/02*** | (2006.01) |
| ***B65D 41/04*** | (2006.01) |

(52) U.S. Cl.

CPC ..... *B65D 21/0204* (2013.01); *B65D 1/0246* (2013.01); *B65D 41/04* (2013.01)

(58) Field of Classification Search

CPC ..... B65D 41/04; B65D 1/0246; B65D 21/02

USPC ..... 215/44, 6

See application file for complete search history.

(56) References Cited

U.S. PATENT DOCUMENTS

| | | | | |
|---|---|---|---|---|
| 2,611,499 A * | 9/1952 | Mayer | B65D 1/10 | 220/916 |
| 2,680,038 A | 6/1954 | Gray | | |
| 2,781,959 A * | 2/1957 | Loveland | A47J 47/16 | 224/103 |
| 2,896,810 A * | 7/1959 | Mulvenna | B65D 25/20 | 220/23.4 |
| 2,949,203 A * | 8/1960 | Robert | A61J 1/05 | D24/117 |

(Continued)

OTHER PUBLICATIONS

Roberts PolyPro, "2-Pack Bottle Carriers", 2 pgs. Retrieved on May 2, 2023 from Internet URL: <https://www.robertspolypro.com/products/2-pack-bottle-handles-beverage-carriers/>.

(Continued)

*Primary Examiner* — Ernesto A Grano

(74) *Attorney, Agent, or Firm* — Stephen P. Scuderi; Heslin Rothenberg Farley & Mesiti PC

(57) ABSTRACT

A container and integrated connector system includes a first container and an integrated connector. The first container includes a first body having a hollow first interior and a laterally projecting first shoulder disposed on an upper portion of the first body. The first container also includes a first neck, which is disposed on the first shoulder of the first body. The integrated connector is integrally connected to the first body. The integrated connector includes a connector member and a ring structure. The connector member projects laterally from the first body. The ring structure is disposed on a distal end portion of the connector member. The ring structure includes a connector opening, which is configured to fit over a second neck of a second container. The ring structure is operable to be removably secured to the second container when the connector opening is fit over the second neck.

22 Claims, 5 Drawing Sheets

(56) References Cited

U.S. PATENT DOCUMENTS 3,327,881 A * 6/1967 Maier ..... A47J 41/02 215/6
3,465,905 A * 9/1969 Martin ..... A47J 41/02 215/6
3,877,198 A 4/1975 Vergobbi
4,063,771 A 12/1977 Calvert
4,093,295 A 6/1978 Erickson
4,196,808 A * 4/1980 Pardo ..... B65D 55/00 222/129
4,231,605 A * 11/1980 Newman ..... B65D 21/0201 294/87.2
4,509,639 A * 4/1985 Thompson ..... B65D 71/50 206/427
4,603,784 A * 8/1986 Chang ..... A61J 9/008 215/11.1
4,685,565 A * 8/1987 Sparling ..... B65D 21/0204 206/427
4,930,645 A * 6/1990 Warehime ..... A61J 9/00 215/390
5,096,246 A 3/1992 Cnare
5,158,191 A * 10/1992 Douglas ..... B65D 81/3288 206/432
5,306,060 A * 4/1994 Borg ..... B65D 71/50 206/199
5,316,159 A * 5/1994 Douglas ..... B65D 81/3288 206/432
D348,002 S * 6/1994 Jones ..... D9/752
D349,459 S * 8/1994 Borg ..... D9/434
5,346,271 A 9/1994 Erickson
D360,362 S * 7/1995 Strong ..... D9/455
5,441,320 A 8/1995 Strong
5,480,204 A 1/1996 Erickson
5,499,738 A * 3/1996 Burleigh ..... B65D 1/04 220/602
5,607,072 A * 3/1997 Rigney ..... B65D 1/04 426/115
5,671,503 A * 9/1997 Uebelacker ..... B65D 21/0204 220/756
5,695,232 A 12/1997 Tipp
5,735,562 A 4/1998 Borg
D411,106 S * 6/1999 Conrad ..... D9/446
D415,963 S * 11/1999 Kapper ..... D9/503
6,105,812 A * 8/2000 Riordan ..... B65D 23/001 220/916
6,149,872 A * 11/2000 Mack ..... B65D 21/0204 206/509
6,179,146 B1 * 1/2001 Betras ..... B65D 47/06 215/229
6,193,201 B1 * 2/2001 Babcock ..... B65D 5/44 248/205.3
6,196,412 B1 * 3/2001 Cattell ..... B65D 25/04 220/254.2
6,206,218 B1 * 3/2001 Young ..... B65D 21/0204 220/756
6,237,800 B1 * 5/2001 Barrett ..... A45F 3/16 215/312
6,439,416 B1 * 8/2002 Hawkins ..... A47J 41/0083 220/524
6,857,544 B2 2/2005 Dahl
6,874,620 B2 4/2005 Mattson et al.
7,516,860 B1 * 4/2009 Fenton ..... B65D 21/0204 215/10
D605,522 S * 12/2009 Jaeger ..... D9/503
7,861,853 B2 1/2011 Borg
D649,057 S * 11/2011 Renz ..... D9/516
8,297,438 B2 10/2012 Crossman
D698,266 S * 1/2014 Downs ..... D9/741
D714,142 S * 9/2014 Hojo ..... D9/436
8,870,027 B2 * 10/2014 Kraenzle ..... B65D 21/0201 222/129
D811,177 S * 2/2018 Marshall ..... D7/707
10,244,789 B2 * 4/2019 Austin ..... A47G 19/22
10,472,117 B1 * 11/2019 Meyer ..... B65D 1/0223
10,478,716 B1 * 11/2019 Solowiej ..... A63F 9/12
2005/0011853 A1 * 1/2005 Brugger ..... B65D 21/0204 215/10
2007/0029275 A1 * 2/2007 Hantman ..... B65D 81/3288 222/129
2008/0000866 A1 * 1/2008 Yates, III ..... B65D 47/243 215/6
2009/0129987 A1 * 5/2009 Tanimoto ..... G01N 35/1002 422/400
2013/0037426 A1 * 2/2013 Shen ..... B65D 81/3288 215/6
2014/0042116 A1 * 2/2014 Shen ..... B65D 21/0204 215/6
2015/0129589 A1 * 5/2015 Essler ..... B65D 81/3288 220/23.83
2019/0233272 A1 * 8/2019 Baughman ..... B65D 25/48
2020/0087050 A1 * 3/2020 Seichei ..... B65D 21/0204
2021/0292074 A1 * 9/2021 Brodsky ..... B65D 21/0205
2022/0324612 A1 * 10/2022 Awad ..... B65D 21/0202

OTHER PUBLICATIONS

Foshan kylin Industry Co., Ltd., "2 Pack Bottle Carrier", 1 pg. Retrieved on May 2, 2023 from Internet URL: <http://www.kylin-industry.com/index.php/product/2+pack+bottle+carrier.html>.

* cited by examiner

CONTAINER AND INTEGRATED CONNECTOR SYSTEM

CROSS-REFERENCE TO RELATED APPLICATIONS

This application is a non-provisional of, and claims the benefit of the filing date of, U.S. provisional application 63/237,749, filed Aug. 27, 2021, entitled, "CONTAINER AND INTEGRATED CONNECTOR SYSTEM," the contents of which are incorporated herein by reference.

TECHNICAL FIELD

The present disclosure relates to connector systems for removably joining two containers together. More specifically, the disclosure relates to a first container and integrated connector system for joining to another second container.

BACKGROUND

Often times, different pairs of substances, such as various pairs of liquids, gels or pills, have functions that complement each other. For example, hand lotions may be paired with hand sanitizers or shampoo may be paired with hair conditioner.

By way of a more specific example, hand sanitizers are often used to reduce the potential spread of bacteria or viruses. This is especially the case during a pandemic. However, the use of a hand sanitizer is often intentionally curtailed, due to the sanitizer stinging or irritating dry and cracked hands. Hand lotions will reduce the stinging and irritation caused by a hand sanitizer. Therefore the use of a hand sanitizer and hand lotion together can promote clean and moisturized hands without irritation. However, containers of hand sanitizers and/or hand lotions are not often conveniently packaged or carried by a user together.

Moreover, this is especially problematic, when a person is traveling and must carry travel sized containers of various complementary substances, such as hand sanitizers and hand lotions or such as shampoo and hair conditioner. In that case, it is easy to misplace and/or forget to bring one or more of the complementary substances. For example, one may bring along shampoo, but forget to bring along the hair conditioner. Alternatively, one may bring along hand sanitizer, but may forget to bring along a hand lotion.

Accordingly, there is a need to conveniently pair and/or keep together various containers of substances, such as liquids, gels or pills, that have complementary functions, so that the substances may be easily used together. Additionally, there is a need to pair travel sized containers of complementary substances so that the paired containers are not easily misplaced or forgotten on a trip.

BRIEF DESCRIPTION

The present disclosure offers advantages and alternatives over the prior art by providing a container and integrated connector system. The system includes a first container that is integrally connected to a connector. The connector includes a connector member that projects laterally from the first container. The connector also includes a ring structure disposed at a distal end portion of the member, wherein the ring structure has a connector opening disposed therethrough. The connector opening is configured to fit over the second neck of a second container and is operable to securely and removably connect the first and second container s together. By connecting the first and second container together, various pairs of substances (such as hand sanitizer and hand lotion, or shampoo and hair conditioner) with complementary functions may be paired together for purposes of complementary use. The container and integrated connector system may be designed for travel sized containers, such as 3 ounce containers or less. Additionally, the first container may have a shape that is designed to conform to the shape of the second container for purposes of reducing the foot print of the two containers when they are paired together and, therefore, making the connected first and second containers easier to pack and/or carry on a trip.

A container and integrated connector system in accordance with one or more aspects of the present disclosure includes a first container and an integrated connector. The first container includes a first body having a hollow first interior and a laterally projecting first shoulder disposed on an upper portion of the first body. The first container also includes a first neck, which is disposed on the first shoulder of the first body. The integrated connector is integrally connected to the first body. The integrated connector includes a connector member and a ring structure. The connector member projects laterally from the first body. The ring structure is disposed on a distal end portion of the connector member. The ring structure includes a connector opening, which is configured to fit over a second neck of a second container. The ring structure is operable to be removably secured to the second container when the connector opening is fit over the second neck.

Another container and integrated connector system in accordance with one or more aspects of the present invention also includes a first container and an integrated connector. The first container incudes a first body having a hollow first interior and a laterally projecting first shoulder disposed on an upper portion of the first body. The first container also includes a first neck disposed on the first shoulder of the first body. The integrated connector is integrally connected to the first shoulder. The integrated connector includes a connector member and a ring structure. The connector member projects laterally from the first shoulder. The ring structure is disposed on a distal end portion of the connector member. The ring structure includes a connector opening operable to fit over a second neck of a second container. Wherein the ring structure is operable to be removably secured to the second container when the connector opening is fit over the second neck.

Another container and integrated connector system in accordance with one or more aspects of the present invention also includes a first container and an integrated connector. The first container includes a first body having a hollow first interior and a laterally projecting first shoulder disposed on an upper portion of the first body. The first container also includes a first neck disposed on the first shoulder of the first body. The integrated connector is integrally connected to the first shoulder. The integrated connector incudes a connector member and a ring structure. The connector member projects laterally from the first shoulder. The ring structure is disposed on a distal end portion of the connector member. The ring structure includes a connector opening operable to removably fit over a second neck of a second container. The second container includes a second body, the second neck and a second cap. The second body incudes a hollow second interior and a laterally projecting second shoulder disposed on an upper portion of the second body. The second neck is disposed on the second shoulder of the second body. The second neck has an outer neck diameter. The second cap has an outer cap diameter.

The connector opening of the ring structure of the connector includes a diameter that is greater than the outer neck diameter of the second neck and smaller than the outer cap diameter of the second cap. When the connector opening is fit over the second neck and the second cap is secured to the second neck, the ring structure is securely captured between the second cap and the second shoulder of the second container.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

DRAWINGS

The disclosure will be more fully understood from the following detailed description taken in conjunction with the accompanying drawings, in which.

Figure 1:
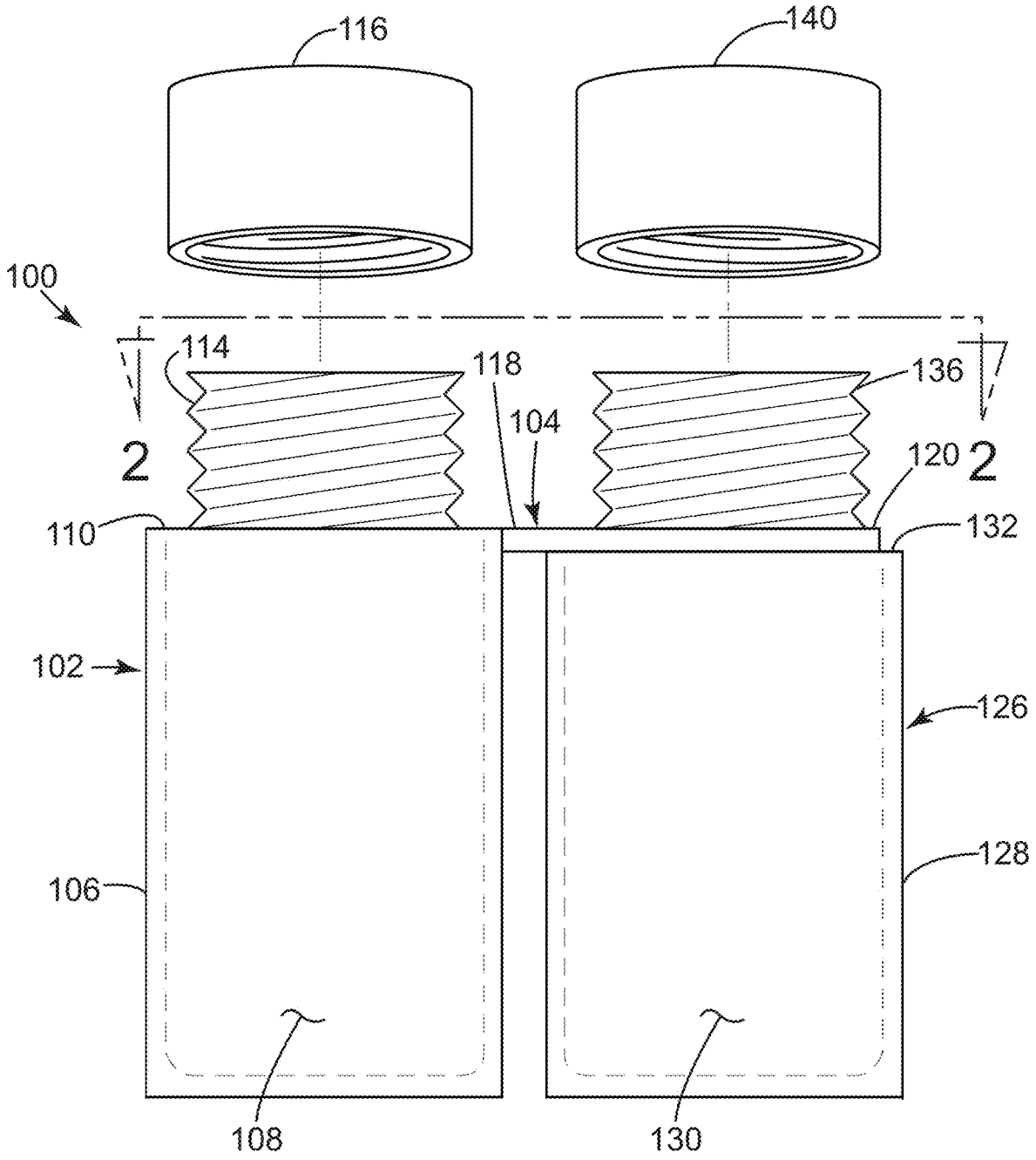
FIG. 1 depicts an example of a side view of a container and integrated connector system having a first container integrally connected to a connector according to aspects described herein.
Figure 4:
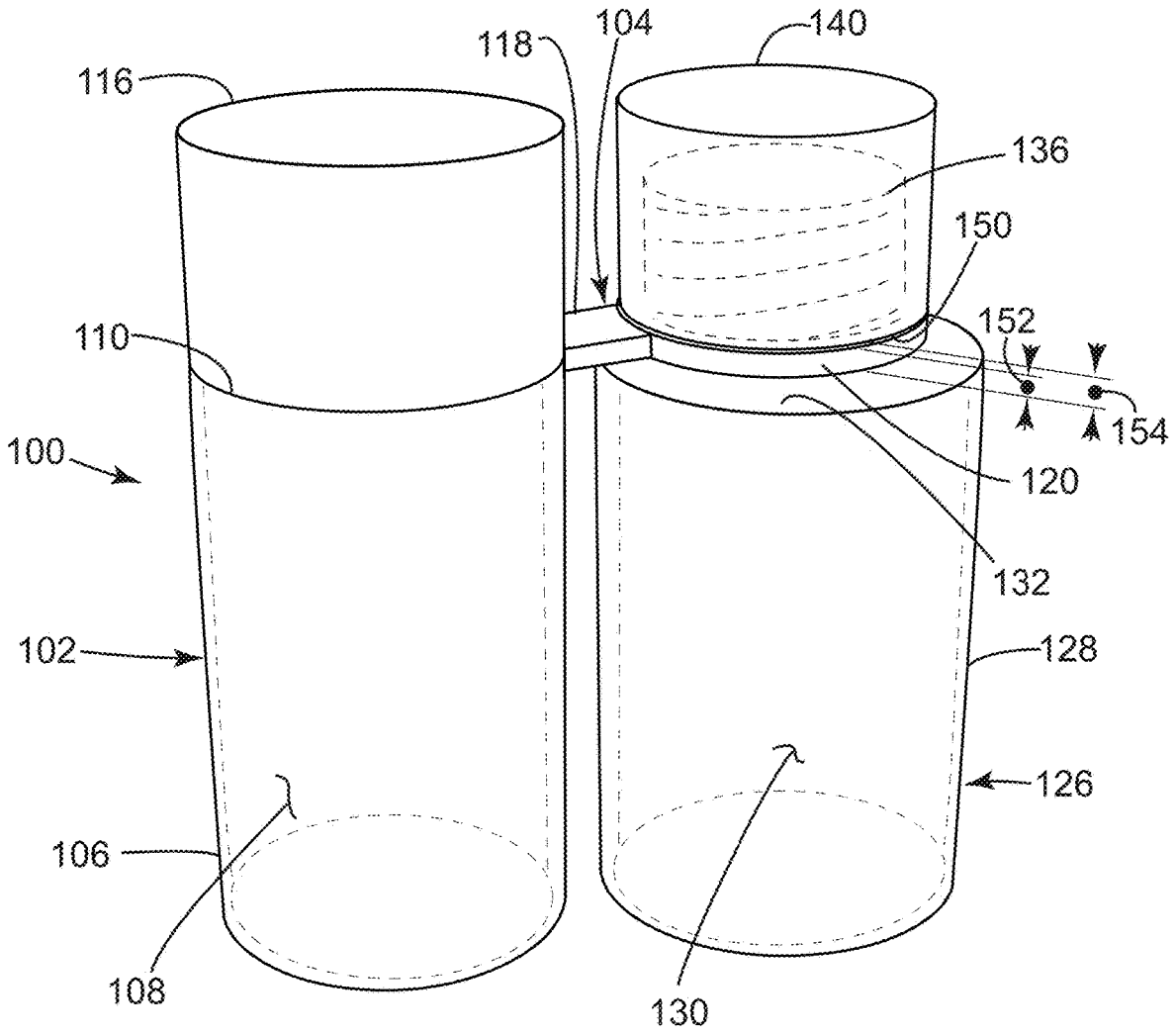
Figure 5:
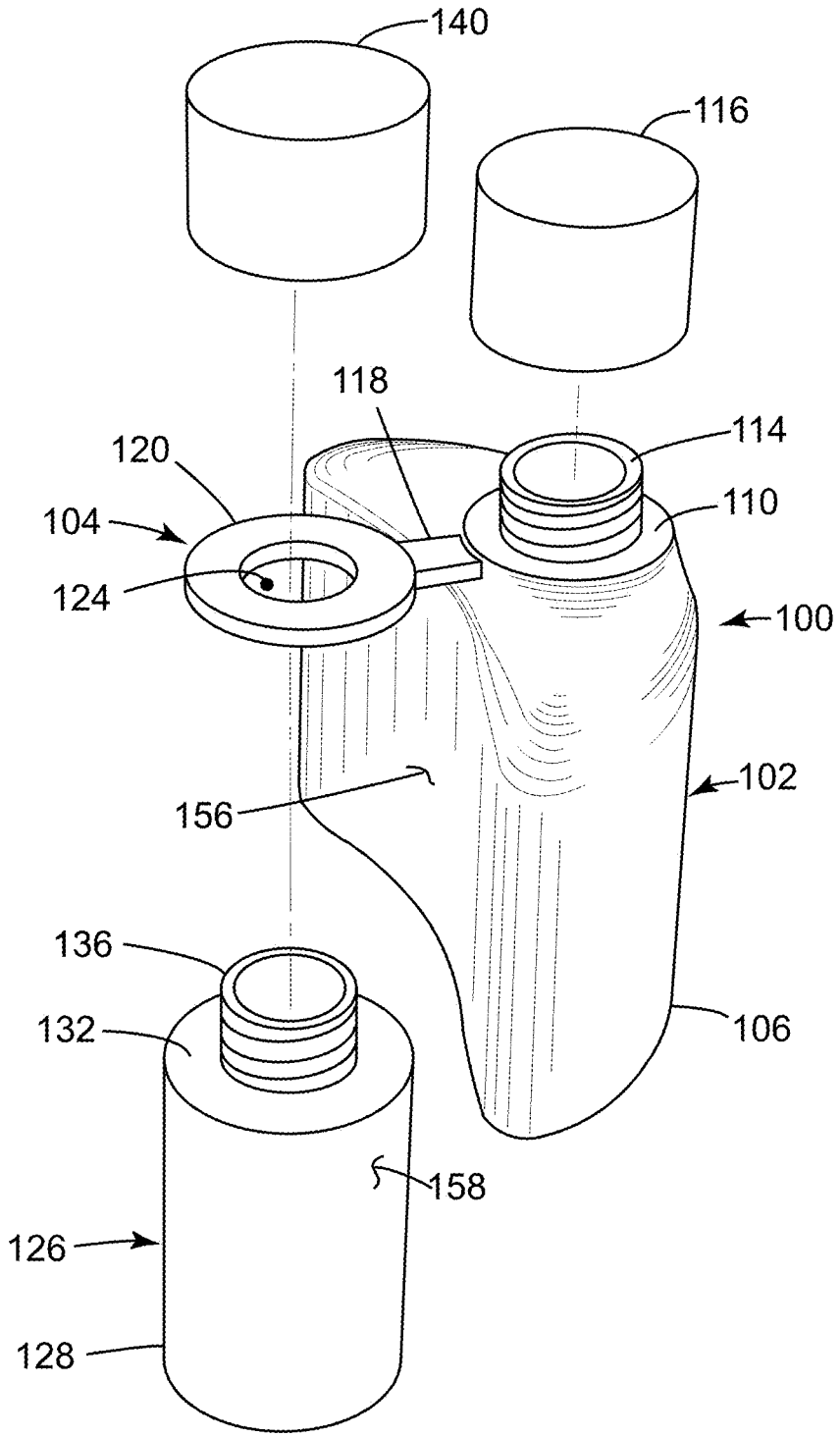

FIG. 4 depicts an example of an assembled view of the container and integrated connector system of FIG. 1 removably connected to the second container, according to aspects described herein; and FIG. 5 depicts an example of an assembled view of another container and integrated connector system having a first container integrally connected to a connector and the connector removably connected to a second container, wherein the first container has a shape that conforms to a shape of the second container.

DETAILED DESCRIPTION

Certain examples will now be described to provide an overall understanding of the principles of the structure, function, manufacture, and use of the methods, systems, and devices disclosed herein. One or more examples are illustrated in the accompanying drawings. Those skilled in the art will understand that the methods, systems, and devices specifically described herein and illustrated in the accompanying drawings are non-limiting examples and that the scope of the present disclosure is defined solely by the claims. The features illustrated or described in connection with one example may be combined with the features of other examples. Such modifications and variations are intended to be included within the scope of the present disclosure.

The terms "significantly", "substantially", "approximately", "about", "relatively," or other such similar terms that may be used throughout this disclosure, including the claims, are used to describe and account for small fluctuations, such as due to variations in processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Figure 2:
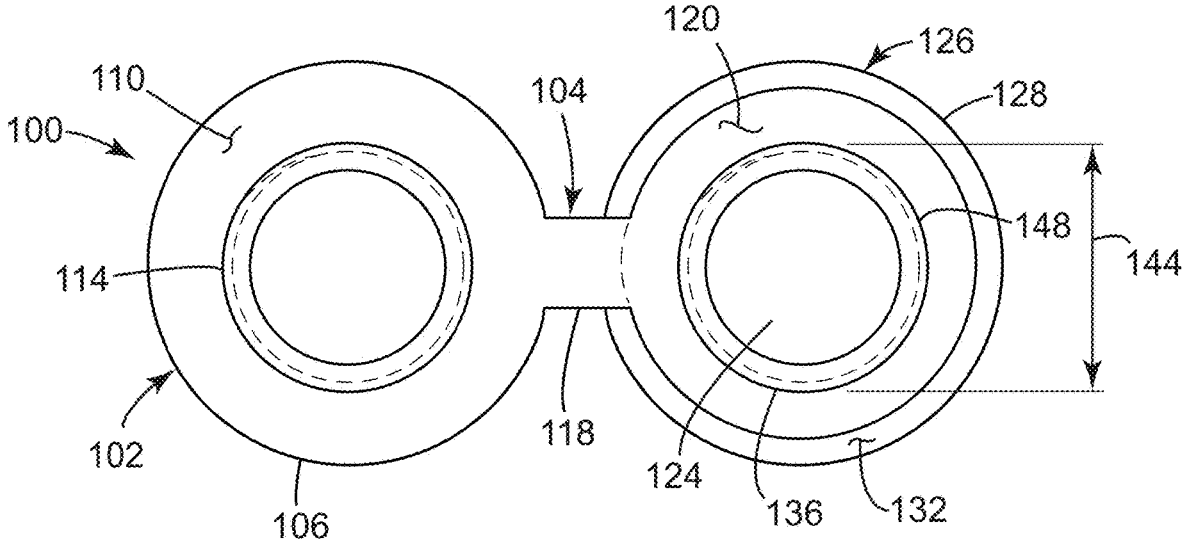
FIG. 2 depicts an example of a top view of the container and integrated connector system of FIG. 1 viewed along the line 2-2 of FIG. 1, according to aspects described herein.

Referring to FIGS. 1 and 2, an example is depicted of a side view (FIG. 1), and a top view (FIG. 2) viewed along the line 2-2 of FIG. 1, of a container and integrated connector system 100 (herein the "system" 100). The system 100 has a first container 102 integrally connected to a connector 104 according to aspects described herein. The first container 102 incudes a first body 106. The first body 106 includes a hollow first interior 108 and a laterally projecting first shoulder 110 that is disposed on an upper portion of the first body 106. The first container 102 also includes a first neck 114 that is disposed on the first shoulder 110 of the first body and a first cap 116 that is removably secured over the first neck 114.

The integrated connector 104 is integrally connected to the first body 106 of the first container 102 and preferably is integrally connected to the first shoulder 110 of the first container 102. "Integrally connected", as used herein, means to be permanently and/or non-removably connected. In the examples illustrated herein, the integrated connector 104 cannot be separated from the first body 106 of the first container 102 without the use of tooling or without damaging the first container 102 or the integrated connector 104. The integrated connector 104 incudes a connector member 118 that projects laterally from the first body 106. The integrated connector 104 also includes a ring structure 120 that is disposed on a distal end portion of the connector member 118. The ring structure 120 includes a connector opening 124 (see FIG. 3) configured to fit over a second neck 136 (see FIG. 3) of a second container 126 (see FIG. 3). The ring structure 120 is operable to be removably secured to the second container 126 when the connector opening 124 is fit over the second neck 136.

Though the connector member 118 of the integrated connector 104 is illustrated herein as being integrally connected to the first shoulder 110 of the first body 106, it is within the scope of this disclosure that the connector member 118 be connected to other portions of the first body 106 other than the first shoulder 110. For example, the connector member 118 may be integrally connected to, and laterally project from, the upper portion of the first body 106 just below the first shoulder 110.

Though the ring structure 120 is illustrated as having a generally circular perimeter, various other configurations of the ring structure 120 are within the scope of this disclosure. For example, the ring structure may have a triangular or square perimeter. Additionally, an outer width or outer diameter of the ring structure 120 may be greater than or less than a width of the connector member 118.

Figure 3:
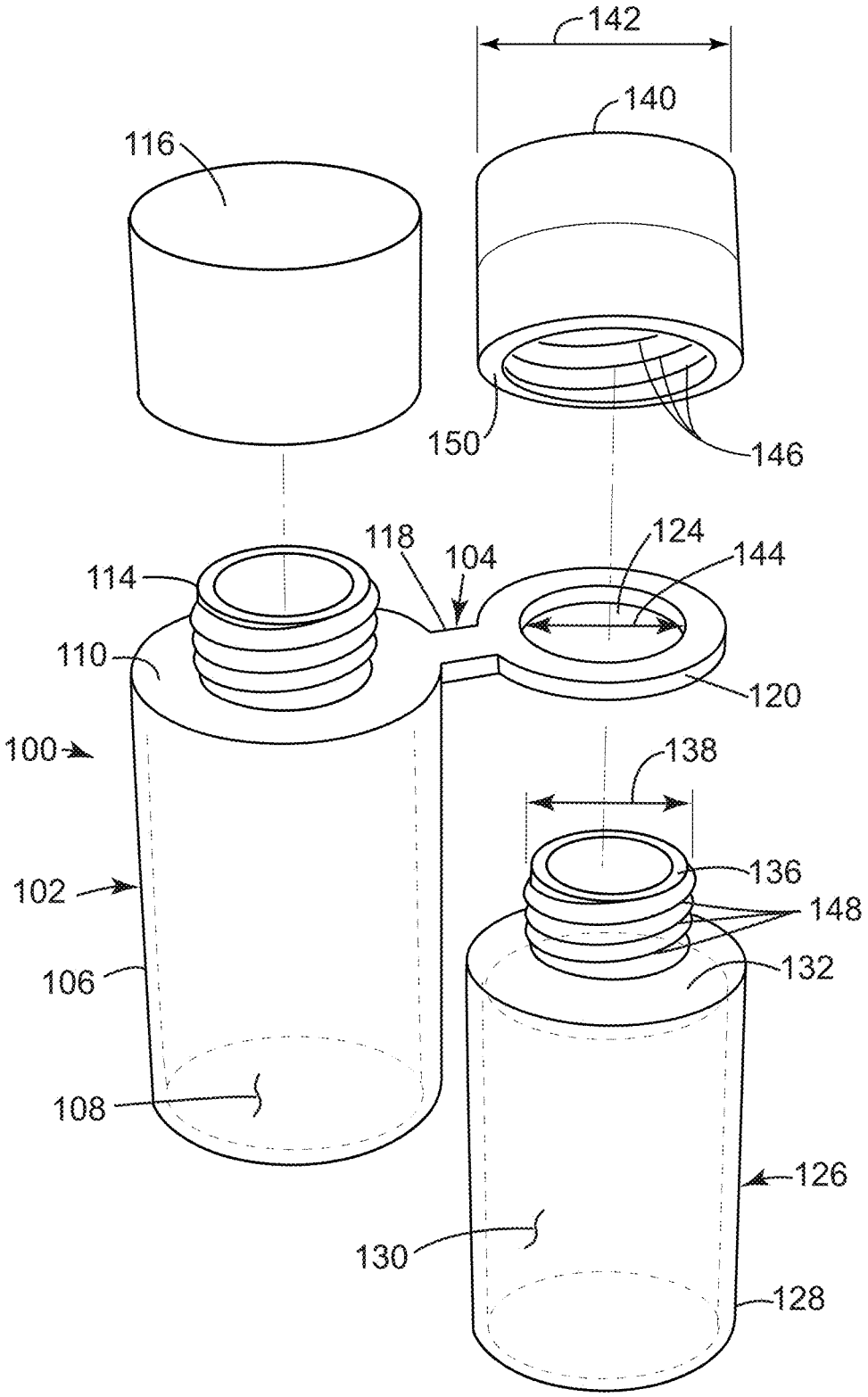
FIG. 3 depicts an example of an exploded view of the container and integrated connector system of FIG. 1 removably connected to a second container, according to aspects described herein.

Referring to FIG. 3 an example is depicted of an exploded view of the container and integrated connector system 100, that is removably connected to a second container 126, according to aspects described herein. The second container 126 includes a second body 128. The second body 128 includes a hollow second interior 130 and a laterally projecting second shoulder 132 disposed on an upper portion of the second body 128.

The second container 126 also includes the second neck 136, which is disposed on the second shoulder 132 of the second body 128, wherein the second neck 136 has an outer neck diameter 138. The second container 126 also includes a second cap 140, which has an outer cap diameter 142.

The connector opening 124 includes an opening diameter 144 that is greater than the outer neck diameter 138 of the second neck 136 and smaller than the outer cap diameter 142 of the second cap 140. Accordingly, when the connector opening 124 of the ring structure 120 is fit over the second neck 136 and the second cap 140 is secured to the second neck 136 (see FIG. 1), the ring structure 120 is securely captured between the second cap 140 and the second shoulder 132 of the second container 126.

In the example illustrated in FIG. 3, the second cap 140 has female threads 146 disposed therein and the second neck 136 has male threads 148 disposed thereon. The male threads 148 of the second neck 136 are configured to mate with the female threads 146 of the second cap 140. As such, the outer neck diameter 138 of the second neck 136 is a major thread diameter of the male threads 148. The major thread diameter being the largest diameter of the male threads 148, measured at the crest of the male threads 148. Accordingly, the connector opening 124 has a diameter 144 that is greater than the major thread diameter of the male threads 148.

Though the example illustrated in FIG. 3, shows the first and second containers 102, 126 as being substantially equal in size, it is within the scope of this disclosure that the containers 102, 126 can be of different sizes. Further, the hollow first and second interiors 108, 130 can be any size and can be different sizes as well. By way of example, for travel sized containers, the first and second interiors 108, 130 of the first and second containers 102, 126 respectively, may each comprise an internal volume of 4 fluid ounces or less, 3 fluid ounces or less, or 2.5 fluid ounces or less. 0029. Referring to FIG. 4, an example is depicted of an assembled view of the container and integrated connector system 100 removably connected to the second container 126, according to aspects described herein.

As illustrate in the example of FIG. 4, when the connector opening 124 is fit over the second neck 136 and the second cap 140 is secured to the second neck 136, the ring structure 120 is securely captured between the second cap 140 and the second shoulder 132 of the second container 126. In this example, a bottom 150 of the second cap 140 is spaced a predetermined distance 152 above the second shoulder 132 when the second cap 140 is secured to the second neck 136 of the second container 126. The ring structure 120 has a thickness 154 that is smaller than the predetermined distance 152 in order to securely fit between the second cap 140 and the second shoulder 132.

By way of example, for travel sized first and second containers 102, 126, the interior volumes of the first and second interiors 108, 130 may be substantially 2 fluid ounces. The outer diameter 138 of the second neck 136 (as well as the outer diameter of the first neck 114) may be substantially 12.00 millimeters (mm) and the opening diameter 144 of the connector opening 124 may be substantially 12.25 mm in order to fit over the second neck 136. Also, the predetermined distance 152 between the bottom 150 of the second cap 140 and the second shoulder 132 may be substantially 2.25 mm and the thickness of the ring structure 120 may be substantially 2 mm in order to fit within the predetermined distance. The first and second containers 102, 126 could contain such liquids as hand sanitizer and hand lotion, or shampoo and hair conditioner.

Though the connector opening 124 is illustrated herein as an annular circular shaped opening, the opening 124 may be other shapes or may include other structures. For example, the opening may be triangular or square shaped. Also the connector opening 124 may include resilient tabs (not shown) the extend inward from the opening diameter 144 of the opening 124. The tabs could be designed to flex as they pass by the male threads 148 of the second neck 136 and lock into place when they pass the last thread 148. In that case, the second cap 140 may not be needed to secure the ring structure 120 to the second container 126.

Referring to FIG. 5, an example is depicted of an assembled view of another embodiment of the container and integrated connector system 100 having a first container 102 integrally connected to a connector 104 and the connector removably connected to a second container 126. In this case however, the second container 126 has a second body 128 having a second body shape and the first container 102 has a first body 106 having a first body shape that conforms to the second body shape. More specifically, the first body 106 has a concave sidewall 156, which conforms to a convex sidewall 158 of the second body 128.

By conforming the shape of the first body 106 to that of the second body 128, the overall footprint of the first and second containers 102, 126 is advantageously reduced. This may be especially advantageous for travel sized containers, such as containers having an interior (such as first and second interiors 108, 130) that have an internal volume of 4 fluid ounces or less, whereby space is a premium for packing and travel purposes.

Such travel sized containers would also be advantageous for any application or purpose where space would be a premium. For example, a travel sized hand sanitizer container paired (or connected to) a travel sized hand lotion container would be advantageous for carrying in a user's pocket or purse, wherein there is a finite amount of storage space.

In this particular example of the container and integrated connector system 100, the integrated connector 104 is not connected to the first shoulder 110. Rather, the connector member 118 is connected to the first body 106 just below the first shoulder 110 and projects laterally outward from an upper portion of the first body 106.

It should be appreciated that all combinations of the foregoing concepts and additional concepts discussed in greater detail herein (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

Although the invention has been described by reference to specific examples, it should be understood that numerous changes may be made within the spirit and scope of the inventive concepts described. Accordingly, it is intended that the disclosure not be limited to the described examples, but that it have the full scope defined by the language of the following claims.

What is claimed is:

1. A container and integrated connector system comprising:

a first container comprising:

a first body comprising a hollow first interior and a laterally projecting first shoulder disposed on an upper portion of the first body, and a first neck disposed on the first shoulder of the first body;

an integrated connector integrally and irremovably connected to the first body, the integrated connector comprising:

a connector member projecting laterally from the first body, the connector member being irremovably attached to the first body, and a ring structure disposed on a distal end portion of the connector member, the ring structure comprising a connector opening; and a second container comprising:

a second body comprising a hollow second interior and a laterally projecting second shoulder disposed on an upper portion of the second body, a second neck being disposed on the second shoulder of the second body, the second neck having an outer neck diameter, and a second cap having an outer cap diameter;

wherein the connector opening is configured to fit over the second neck of the second container and the ring structure is operable to be removably secured to the second container when the connector opening is fit over the second neck;

wherein the connector opening comprises a diameter that is greater than the outer neck diameter of the second neck and smaller than the outer cap diameter of the second cap; and wherein, when the connector opening is fit over the second neck and the second cap is secured to the second neck, the ring structure is securely captured between the second cap and the second shoulder of the second container.

2. The container and integrated connector system of claim 1, wherein the connector member is integrally connected to the first shoulder of the first container.

3. The container and integrated connector system of claim 2, wherein a first shoulder height, defined by the distance from the bottom of the first container to the first shoulder of the first container, is substantially equal to a sum of a second shoulder height, defined by the distance from the bottom of the second container to a second shoulder of the second container, plus the width of the ring structure of the integrated connector.

4. The container and integrated connector system of claim 1, wherein:

the second body has a second body shape; and the first body has a first body shape that conforms to the second body shape.

5. The container and integrated connector system of claim 4, wherein the first body has a concave sidewall, which conforms to a convex sidewall of the second body.

6. The container and integrated connector system of claim 1, comprising:

the second cap having female threads disposed therein;

the second neck having male threads disposed thereon, the male threads of the second neck configured to mate with female threads of the second cap; and wherein the outer neck diameter of the second neck is a major thread diameter of the male threads; and wherein the connector opening has a diameter that is greater than the major thread diameter of the male threads.

7. The container and integrated connector system of claim 1, wherein:

a bottom of the second cap is spaced a predetermined distance above the second shoulder when the second cap is secured to the second neck of the second container; and the ring structure has a thickness that is smaller than the predetermined distance.

8. The container and integrated connector system of claim 1, wherein the hollow first interior of the first container comprises an internal volume of 3 fluid ounces or less.

9. The container and integrated connector system of claim 1, wherein the first and second interiors of the first and second containers, respectively, each comprise an internal volume of 3 fluid ounces or less.

10. A container and integrated connector system comprising:

a first container comprising:

a first body comprising a hollow first interior and a laterally projecting first shoulder disposed on an upper portion of the first body, and a first neck disposed on the first shoulder of the first body;

an integrated connector integrally and irremovably connected to the first shoulder, the integrated connector comprising:

a connector member projecting laterally from the first shoulder, the connector member being irremovably attached to the first shoulder, and a ring structure disposed on a distal end portion of the connector member, the ring structure comprising a connector opening; and a second container comprising:

a second body comprising a hollow second interior and a laterally projecting second shoulder disposed on an upper portion of the second body, a second neck being disposed on the second shoulder of the second body, the second neck having an outer neck diameter, and a second cap having an outer cap diameter;

wherein the connector opening is configured to fit over the second neck of the second container and the ring structure is operable to be removably secured to the second container when the connector opening is fit over the second neck;

wherein the connector opening comprises a diameter that is greater than the outer neck diameter of the second neck and smaller than the outer cap diameter of the second cap; and wherein, when the connector opening is fit over the second neck and the second cap is secured to the second neck, the ring structure is securely captured between the second cap and the second shoulder of the second container.

11. The container and integrated connector system of claim 10, wherein:

the second body has a second body shape; and the first body has a first body shape that conforms to the second body shape.

12. The container and integrated connector system of claim 10, comprising:

the second cap having female threads disposed therein;

the second neck having male threads disposed thereon, the male threads of the second neck configured to mate with female threads of the second cap; and wherein the outer neck diameter of the second neck is a major thread diameter of the male threads; and wherein the connector opening has a diameter that is greater than the major thread diameter of the male threads.

13. The container and integrated connector system of claim 10, wherein:

a bottom of the second cap is spaced a predetermined distance above the second shoulder when the second cap is secured to the second neck of the second container; and the ring structure has a thickness that is smaller than the predetermined distance.

14. The container and integrated connector system of claim 10, wherein the first and second interiors of the first and second containers, respectively, each comprise an internal volume of 3 fluid ounces or less.

15. A container and integrated connector system comprising:

a first container comprising:

a first body comprising a hollow first interior and a laterally projecting first shoulder disposed on an upper portion of the first body, and a first neck disposed on the first shoulder of the first body; and an integrated connector integrally and irremovably connected to the first shoulder, the integrated connector comprising:

a connector member projecting laterally from the first shoulder, the connector member being irremovably attached to the first shoulder, and a ring structure disposed on a distal end portion of the connector member, the ring structure comprising a connector opening; and a second container having a second neck;

wherein the connector opening is configured to fit over the second neck of the second container;

wherein the second container comprises:

a second body comprising a hollow second interior and a laterally projecting second shoulder disposed on an upper portion of the second body, the second neck being disposed on the second shoulder of the second body, the second neck having an outer neck diameter, and a second cap having an outer cap diameter;

wherein the connector opening comprises a diameter that is greater than the outer neck diameter of the second neck and smaller than the outer cap diameter of the second cap; and wherein, when the connector opening is fit over the second neck and the second cap is secured to the second neck, the ring structure is securely captured between the second cap and the second shoulder of the second container.

16. The container and integrated connector system of claim 15, wherein the first and second interiors of the first and second containers, respectively, each comprise an internal volume of 3 fluid ounces or less.

17. The container and integrated connector system of claim 15, wherein:

the second body having a second body shape; and the first body has a first body shape that conforms to the second body shape.

18. The container and integrated connector system of claim 17, wherein:

the first body has a concave sidewall, which conforms to a convex sidewall of the second body.

19. The container and integrated connector system of claim 15, wherein:

a bottom of the second cap is spaced a predetermined distance above the second shoulder when the second cap is secured to the second neck of the second container; and the ring structure has a thickness that is smaller than the predetermined distance.

20. A container and integrated connector system comprising:

a first container comprising:

a first body comprising a hollow first interior and a laterally projecting first shoulder disposed on an upper portion of the first body, and a first neck disposed on the first shoulder of the first body;

an integrated connector integrally and irremovably connected to the first shoulder, the integrated connector comprising:

a connector member projecting laterally from the first shoulder, the connector member being irremovably attached to the first shoulder, and a ring structure disposed on a distal end portion of the connector member, the ring structure comprising a connector opening; and a second container having a second neck;

wherein the connector opening is configured to fit over the second neck of the second container and the ring structure is operable to be removably secured to the second container when the connector opening is fit over the second neck; and wherein a first shoulder height, defined by the distance from the bottom of the first container to the first shoulder of the first container, is substantially equal to a sum of a second shoulder height, defined by the distance from the bottom of the second container to a second shoulder of the second container, plus the width of the ring structure of the integrated connector.

21. A container and integrated connector system comprising:

a first container comprising:

a first body comprising a hollow first interior and a laterally projecting first shoulder disposed on an upper portion of the first body, and a first neck disposed on the first shoulder of the first body;

an integrated connector integrally and irremovably connected to the first body, the integrated connector comprising:

a connector member projecting laterally from the first body, the connector member being irremovably attached to the first body, and a ring structure disposed on a distal end portion of the connector member, the ring structure comprising a connector opening; and a second container having a second neck;

wherein the connector opening is configured to fit over the second neck of the second container and the ring structure is operable to be removably secured to the second container when the connector opening is fit over the second neck; and wherein the second container has a second body having a second body shape; and the first body has a first body shape that conforms to the second body shape.

22. A container and integrated connector system comprising:

a first container comprising:

a first body comprising a hollow first interior and a laterally projecting first shoulder disposed on an upper portion of the first body, and a first neck disposed on the first shoulder of the first body;

an integrated connector integrally and irremovably connected to the first shoulder, the integrated connector comprising:

a connector member projecting laterally from the first shoulder, the connector member being irremovably attached to the first shoulder, and a ring structure disposed on a distal end portion of the connector member, the ring structure comprising a connector opening; and a second container having a second neck;

wherein the connector opening is configured to fit over the second neck of the second container and the ring structure is operable to be removably secured to the second container when the connector opening is fit over the second neck; and wherein the second container has a second body having a second body shape; and the first body has a first body shape that conforms to the second body shape.

* * * * *